United States Patent [19]

Hodges

[11] 3,971,475

[45] July 27, 1976

[54] TRAY FOR A DOCUMENT HANDLING SYSTEM

[75] Inventor: Ronald R. Hodges, Grandville, Mich.

[73] Assignee: Steelcase, Inc., Grand Rapids, Mich.

[22] Filed: Apr. 16, 1975

[21] Appl. No.: 568,673

[52] U.S. Cl. ..... 211/88; 211/55; 312/183; 312/351

[51] Int. Cl.[2] ..... B65D 21/04; A47F 5/08

[58] Field of Search ..... 312/234, 183, 184; 211/50, 87, 177, 88, 11, 10, 94, 126, 184; 248/223; 206/72, 73

[56] References Cited

UNITED STATES PATENTS

| | | | |
|---|---|---|---|
| 2,034,116 | 3/1936 | Palen | 211/55 |
| 2,742,161 | 4/1950 | Nuttall | 211/10 |
| 2,909,287 | 10/1959 | Galassi | 211/55 |
| 2,974,807 | 3/1961 | Furrer | 211/126 |
| 3,031,088 | 4/1962 | Ribbens | 211/176 |
| 3,047,158 | 7/1962 | Scholl | 211/126 |
| 3,112,912 | 12/1963 | Alvarez | 248/223 |
| 3,144,248 | 8/1964 | Fornell et al. | 270/58 |
| [illegible] | 4/1965 | Meyers | 211/10 |
| 3,515,283 | 6/1970 | Poteat | 211/55 |
| 3,661,271 | 5/1972 | Fisher et al. | 211/88 |
| 3,698,565 | 10/1972 | Weber | 211/87 |
| 3,791,528 | 2/1974 | Brendgord | 211/88 |
| 3,860,309 | 1/1975 | Brendgord | 312/351 |

FOREIGN PATENTS OR APPLICATIONS

| | | |
|---|---|---|
| 632,642 | 1/1953 | Canada |
| 1,285,520 | 1/1962 | France |

*Primary Examiner*—Casmir A. Nunberg
*Attorney, Agent, or Firm*—Price, Heneveld, Huizenga & Cooper

[57] ABSTRACT

A tray for a manual document handling system for use in processing and handling documents in offices and the like and for use on specially designed support panels. The trays are of a special shape for easy insertion, storing and retrieving of documents in an orderly fashion and include an inclined side wall against which the documents lay. An insert sheet member is provided to be mounted against the side wall for increasing the surface area against which papers lay when inserted into the tray. An unique locking mechanism is provided for securing the insert sheet member in place.

12 Claims, 5 Drawing Figures

TRAY FOR A DOCUMENT HANDLING SYSTEM

BACKGROUND OF THE INVENTION

This invention is an improvement over the tray disclosed in the co-pending application Ser. No. 546,280, filed Feb. 3, 1975 and entitled DOCUMENT HANDLING SYSTEM of which this and that application have common assignees.

In the above-said patent application the basic support panels on which the trays of this invention are to be hung is disclosed. Furthermore the said co-pending application discloses a multitude of different sizes of trays for handling the various documents with which the system is to be used.

One drawback of the system as disclosed in the above application is the number of trays that have to be kept in stock and on hand in order to obtain the versatility of the system.

SUMMARY OF THE INVENTION

The present invention relates to a specially designed tray with an insert specially designed for the tray so as to reduce the number of trays required to be kept in stock and on hand.

The particular tray of this invention with its insert provides for the changing of the size of the tray for handling different sizes of documents.

The present invention also provides a tray having a simple means for mounting the insert on the tray.

This invention also provides for a means for mounting the insert on the tray in a way that it will be locked in position while it is mounted on the panel support but which can be easily removed once the tray is removed from the panel support.

The present invention makes for a much wider variety of different shapes of trays for different size documents that can be arranged on the panel in different arrangements so as to give efficient use of the trays and the panel support.

Having described very briefly the various objects and advantages of the present invention, reference is now made to the drawings wherein:

PREFERRED EMBODIMENT OF THE INVENTION

Before referring more specifically to the drawings, it should be understood that the tray of this invention is intended to be used in conjunction with the document handling system of co-pending application Ser. No. 546,280 filed Feb. 3, 1975 and entitled DOCUMENT HANDLING SYSTEM. Therefore, the entire disclosure of that patent application is intended to be incorporated by reference within this application.

Figure 1:
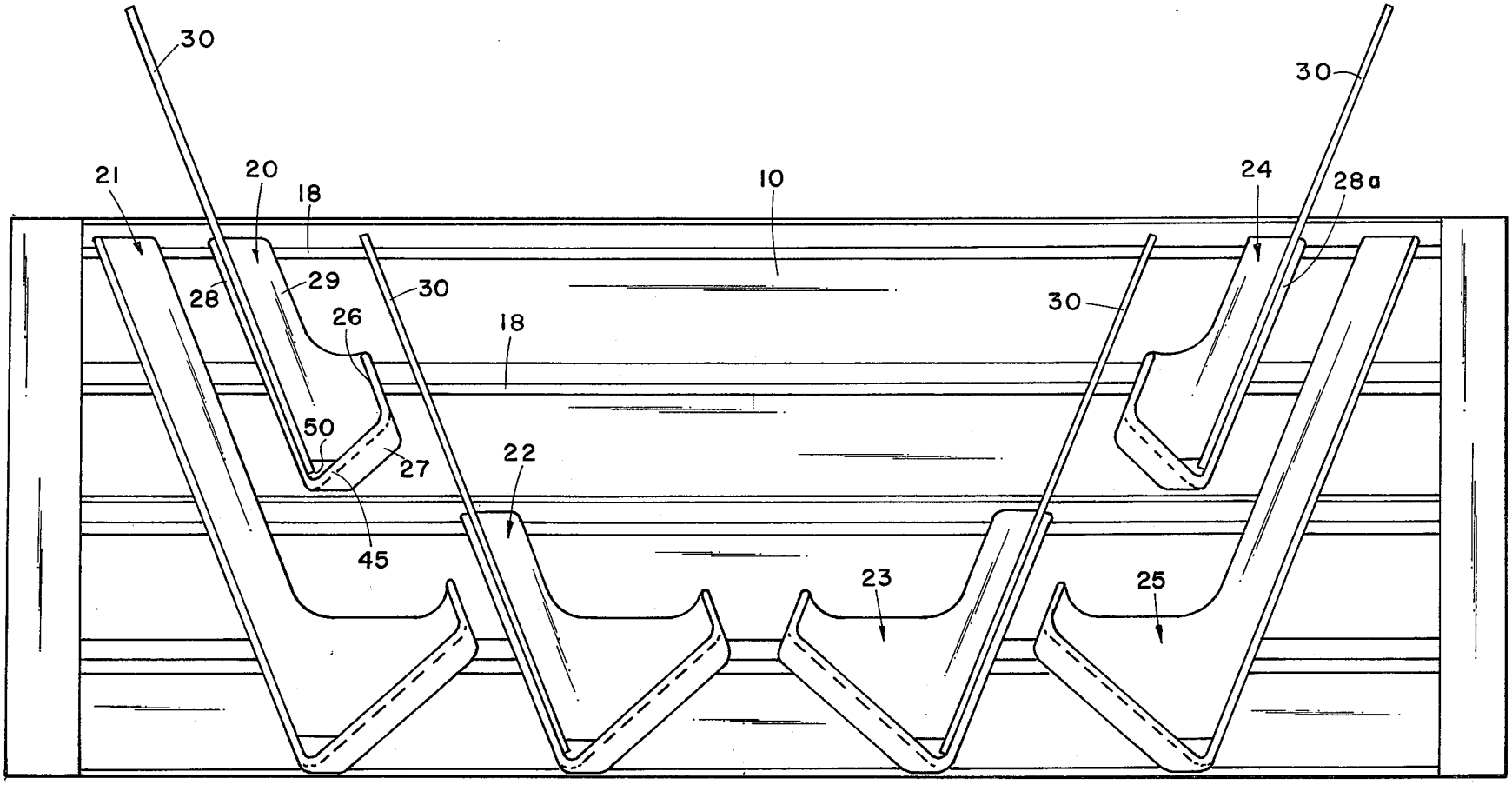
FIG. 1 is a front elevational view of a panel with some of the various shapes and sizes of trays made possible by this invention.

Referring to FIG. 1, it will be noted that the system like that referred to in the above identified co-pending application includes a panel assembly 10 and trays 20, 21, 22, 23, 24 and 25, all of which extend vertically from and are hung on the tray support panel 10. It will be noted that the trays are of various shapes and sizes. Specifically, trays 20, 21 and 22 are left-handed trays and trays 23, 24 and 25 are right-handed trays. Further, trays 21, 22, 23 and 25 are two horizontal modules (4 inches) wide, while trays 20 and 24 are each one horizontal module (2 inches) wide. It will also be noted that trays 21 and 25 are two vertical modules (10 inches) high while trays 20, 22, 23 and 24 (without considering the insert which will be described hereinafter) are one module (5 inches) high. It should be understood that a module size can be any dimension rather than 2 inches and 5 inches. For reasons which will be explained in greater detail hereinafter, these trays as shown are sufficient for handling all documents in an average office. Therefore, only six trays of different sizes and shapes are required to be stocked whereas in the system described in the above identified co-pending application, eight different sizes and shapes of trays were required to be stocked. In fact, in accordance with this invention, it is quite plausible to use only four different trays. This is made possible by the combination of the specially designed tray, such as tray 20, with an insert sheet member 30 which will now be described in greater detail.

Referring to FIG. 1, the insert sheet members 30 are shown mounted in the trays 20, 22, 23 and 24. All of these insert members are of exactly the same construction. Further, each of the trays 20, 22, 23 and 24 are of substantially the same construction, the difference being in their width and whether they are right-handed or left-handed. In each of these trays the construction for mounting the insert sheet 30 is identical and therefore only the construction of tray 20 in conjunction with the insert member 30 will be described.

Figure 2:
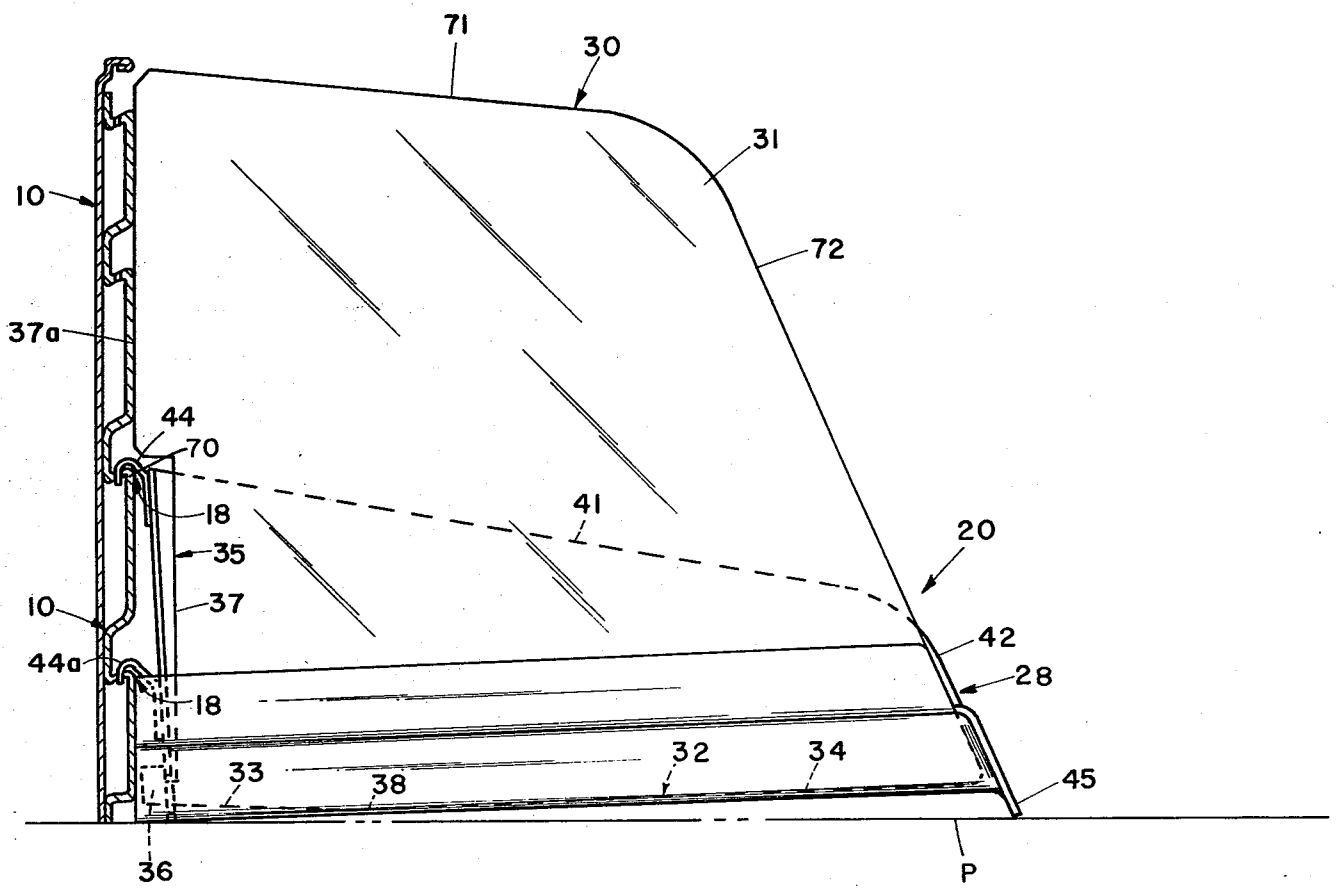
FIG. 2 is a side elevational view of a section of a panel with one tray mounted thereon.
Figure 3:
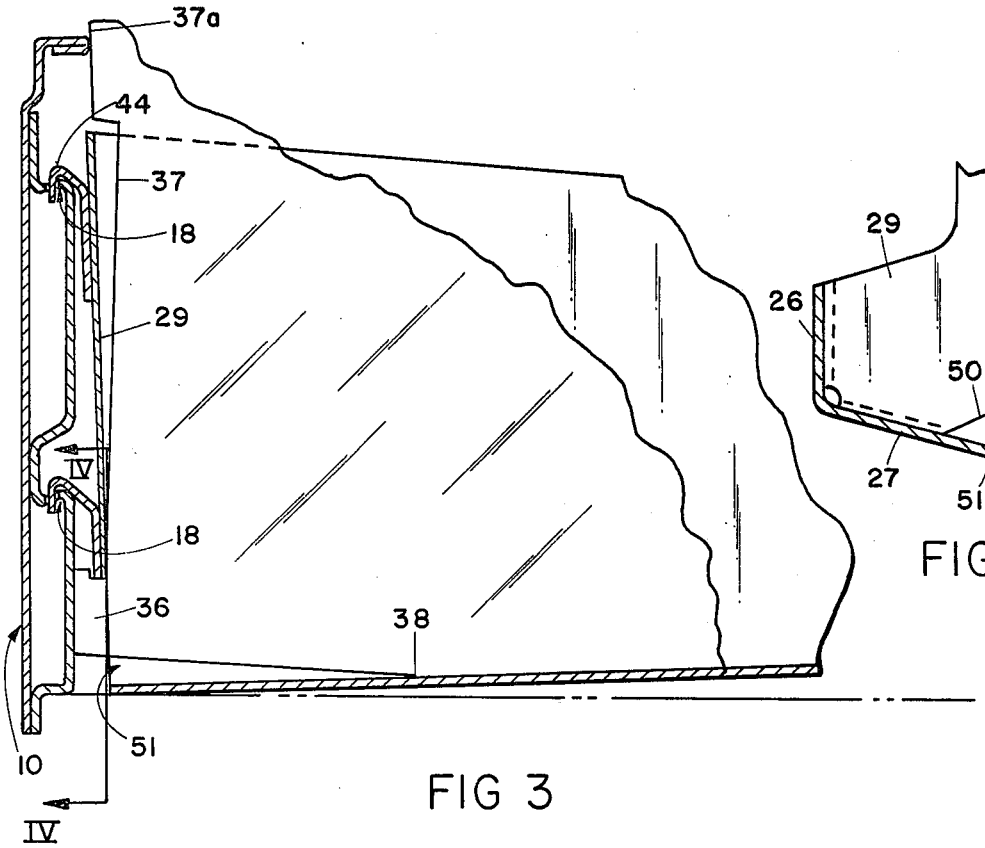
FIG. 3 is a partial cross-sectional view of one tray mounted on a panel and illustrating in greater detail the insert sheet locked in place.

Referring to tray 20 in the drawings, it will be noted that the tray includes a bottom wall 27, a side wall 28, a back or end wall 29 and a retaining lip 26. As will be seen from FIGS. 2 and 3, the bottom wall 27, from back to front, is sloped upwardly from the horizontal plane "P" and as viewed in FIG. 1 is sloped upwardly from side 28 to lip 26 (FIG. 1). The side wall 28 of tray 20 is sloped to the left and the angle between the side wall 28 and the bottom wall 27 is less than 90°. It should be understood that on a right-hand tray such as tray 24, its side wall 28*a* is sloped to the right. In addition, as best shown in FIG. 3, the back wall 29 is sloped forwardly from the top to bottom. It should also be observed as shown in FIG. 2, the top edge 41 of the side wall 28 is inclined downwardly and the front edge 42, from bottom to top is inclined rearwardly. As pointed out in the co-pending application referred to above, this slope or inclination of the edges 41 and 42 provides an open area on the sides of the document so that the document can be grasped more easily when inserted and removed from the tray. It should be understood that although the specific size and slope for the sides of tray 20, as shown in the drawings are decribed, the same general slope of the sides of the other trays are the same.

At the back of the tray near the back wall 29 are mounted the hooks 44 and 44*a*. These hooks fit over corresponding hooks 18 provided on the panel 10. These hooks are formed by the elongated protruding members 70 having a slanted top wall in which spaced slots are cut. The hooks 44 and 44*a* extend into these slots. It will thus be seen that the trays are hung on the panels by hooking the hooks 44 of the trays over the hooks 18 of the panels.

Figure 4:
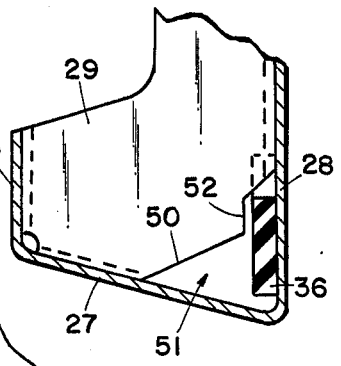
FIG. 4 is a partial cross-sectional view taken along the plane IV—IV of FIG. 3.

Each of the trays as illustrated by tray 20 has a cutout 50 best shown in FIG. 4. This cutout is in the back wall 29 at the juncture of the side wall 28 and the bottom wall 27. Although these trays can be constructed of many different materials, they are presently constructed of metal sheeting and accordingly the cutout 50 not only provides the opening 51 for purposes as will be described hereinafter, but also is useful in the painting technique of the tray since it permits the paint to run out of the corner.

It will be noted that at the front of the tray a downturned flange 45 is provided. The flange can be a matted surface to accept pencil write-on in order to identify the documents in the tray, or in the alternative a gummed label or tape can be used for such identification.

Insert sheet member 30 is a flat sheet of material which is of the same length as the tray 20 but is two modules (ten inches) high. This insert sheet member is of a specific configuration which includes a bottom edge 32 having a portion 33 inclined upwardly from the remainder portion 34. The purpose of the shape of the edge 32 is to provide a means for tipping the insert sheet member in a manner which will be described in greater detail hereinafter.

The back edge 35 of the insert 31 is cut or shaped to provide a hook 36 at its lower end and a recess 37 immediately above the hook 36. The recess is provided to receive the back wall 29 of the tray when the hook 36 is locked into position. The other edges 71 and 72 of the insert member 30 are sloped to correspond with the edges 41 and 42, respectively, of the tray side wall 28.

Figure 5:
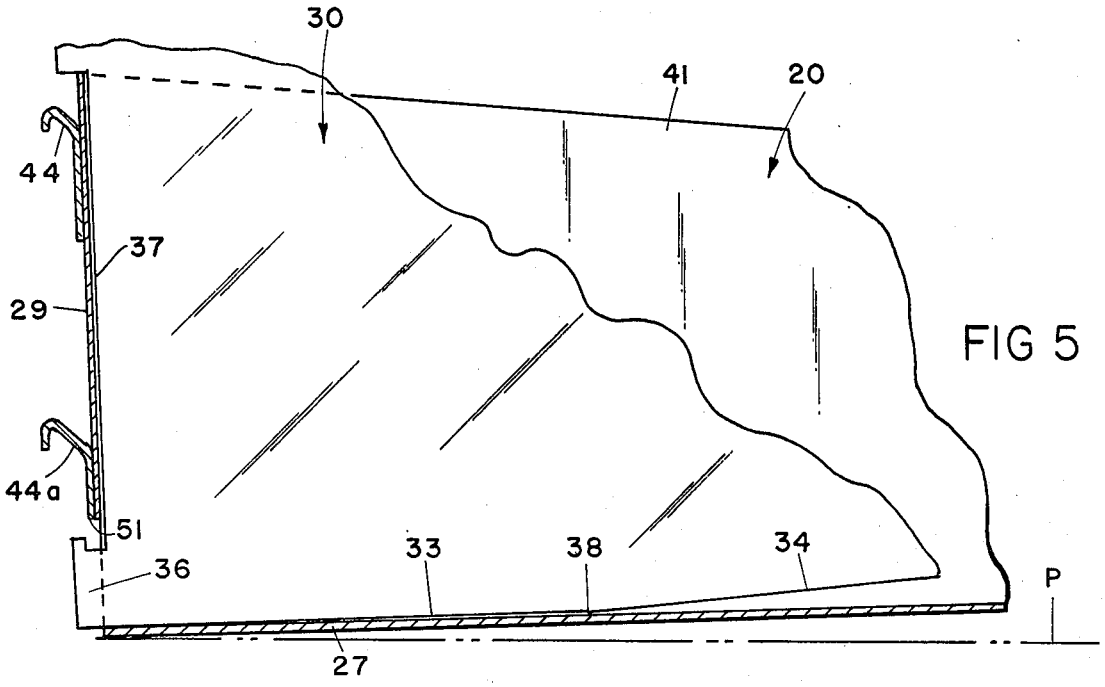
FIG. 5 is a side elevational, cross-sectional view of a tray showing the insert sheet member in position just previous to it being locked into position.

FIGS. 3, 4 and 5 best illustrate how the insert member 30 is mounted or secured to the tray 20. Starting with FIG. 5, it will be seen that the hook 36 formed at the lower end of the back edge 35 is positioned for insertion into the opening 51 by tipping the insert about fulcrum 38 formed at the juncture of the portions 33 and 34 of the bottom edge 32. This tipping is also made possible by the cutout 37 of the back edge 35 of the insert. Thus, as shown in FIG. 5, hook 36 can be inserted through the opening 51 when the portion 33 of the bottom edge is flat against the bottom wall 27 of the tray. Once the hook 36 is inserted through the opening 51, the insert is tipped upwardly to the position shown in FIG. 3 which causes the hook 36 to hook the back wall 29 of the tray which secures the insert in place against the side wall 28 of the tray.

The dimensions and placement of hook 36 of insert 30, the hooks 44 and 44*a* of the tray and the edge 37*a* of the insert 30 are such that when the tray with the insert mounted thereon is hung on the panel 10, the edge 37*a* substantially abuts against the panel 10 (see FIGS. 2 and 3). As a result, the insert 30 is held in place and cannot be removed from the tray since any tipping action downwardly such as to the position in FIG. 5, is prohibited. Further, opening 51 is shaped to provide a surface 52 which prohibits the insert 30 from tipping away from the wall 28 of tray 20. Accordingly, insert 30 is locked in place so long as the tray is mounted on the panel 10.

It will be seen from this construction that a tray such as trays 22, 23 and 24 can be expanded in size for accommodating larger size documents by merely mounting the insert in the tray as has just been described. Further, it will be seen that a tray of one vertical module (5 inches) can be modified to a two module sized tray.

Having described my invention, it should become obvious that although I have shown a preferred embodiment, other embodiments and modifications can be utilized without departing from the scope of this invention. Therefore, the scope thereof shall be construed only as limited by the following claims.

The embodiments of the invention in which an exclusive property or privilege is claimed are defined as follows:

1. In combination with a tray for a manual paper handling system having an upright support panel means with means for removably hanging said tray thereon, the improvement comprising said tray having a bottom wall, a side wall and a back wall and hanging means for removably mounting said tray on said panel means with said back wall located immediately adjacent said panel means, said side wall extending substantially perpendicularly away from said panel means and inclined from the vertical, and said bottom wall extending away from said panel; said bottom and side walls providing a support for papers with the bottom edge of the papers resting on the bottom wall and the side wall providing a support for laying papers thereagainst; a rigid insert sheet member having an outline of greater dimension than said side wall; and means for removably securing said insert sheet member in place against said side wall for increasing the surface area against which papers lay when inserted into said tray.

2. The tray of claim 1 in which said insert sheet member and said back wall each have means cooperating to form said removable means for securing said sheet member in place against said side wall.

3. The tray of claim 2 in which said back wall has an opening and said sheet member along one edge adjacent said back wall has a hook means, said opening receiving said hook means to form the said means for securing said sheet member in place against said side wall.

4. The tray of claim 2 in which means is provided whereby said insert sheet member is removable from said tray only when said tray is removed from hanging position on said panel means.

5. The tray of claim 3 in which means is provided to lock the hook means into position within said opening when said tray is mounted on said panel means.

6. The tray of claim 3 in which the means for locking said hook means within said opening comprises said insert sheet member including a bottom edge and back edge; said bottom edge including a portion of its length adjacent said back edge being inclined rearwardly and upwardly from the remainder of said bottom edge; and said back edge includes said hook means; said inclined portion of said sheet member permitting tipping of the back edge of said sheet member downwardly to position said hook means for insertion into said opening whereby when said back edge of said sheet member is tipped upwardly after said hook means is inserted in said opening, said hook means secures said sheet member into locked position on said tray.

7. The tray of claim 6 in which when the tray is mounted on said panel means with the sheet member in place and the hook means is in locked position, a portion of said insert sheet member abuts against said panel means to prevent tipping of said sheet member downwardly whereby said sheet member is not removable while said tray is mounted on said panel means.

8. The tray of claim 7 in which the said portion of said insert sheet member which abuts against said panel means is an edge thereof located above the side wall of said tray.

9. The tray of claim 3 in which said opening is formed by a portion of said back wall at the juncture of said side and bottom walls being cut out.

10. The tray of claim 3 in which the means for locking said hook means within said opening comprises said insert sheet member including a bottom edge and back edge; said bottom edge being formed to provide a vertical movement of said back edge about an arc spaced forwardly of said back wall thereby permitting tipping of the back edge of said sheet member in one direction to position said hook means for insertion into said opening whereby when said back edge of said sheet member is tipped in an opposite direction to said one direction after said hook means is inserted in said opening, said hook means secures said sheet member into locked position on said tray.

11. The tray of claim 10 in which when the tray is mounted on said panel means with the sheet member in place and the hook means in locked position a portion of said insert sheet member abuts against said panel means to prevent tipping of said sheet member in said one direction whereby said sheet member is not removable while said tray is mounted on said panel means.

12. The tray of claim 11 in which the said portion of said insert sheet member which abuts against said panel means is an edge thereof located above the side wall of said tray.

* * * * *